US005505470A

United States Patent [19]

Hoshizaki

[11] Patent Number: 5,505,470

[45] Date of Patent: Apr. 9, 1996

[54] TRI-AXLE SYSTEM FOR IN-LINE ROLLER SKATES

[75] Inventor: T. Blaine Hoshizaki, Montreal West, Canada

[73] Assignee: Canstar Sports Group, Inc., Montreal, Canada

[21] Appl. No.: 356,134

[22] Filed: Dec. 15, 1994

[51] Int. Cl.[6] ..... A63C 17/14

[52] U.S. Cl. ..... 280/11.22; 280/11.27

[58] Field of Search ..... 280/11.19, 11.27, 280/11.28, 11.26, 11.22, 11.23, 87.041, 87.042

[56] References Cited

U.S. PATENT DOCUMENTS

| | | | |
|---|---|---|---|
| 4,909,523 | 3/1990 | Olson | 280/11.27 |
| 5,048,848 | 9/1991 | Olson et al. | 280/11.27 |
| 5,068,956 | 12/1991 | Malewicz | 280/11.27 |
| 5,092,614 | 3/1992 | Malewicz | 280/11.27 |
| 5,190,301 | 3/1993 | Malewicz | 280/11.27 |
| 5,253,884 | 10/1993 | Landers | 280/11.27 |
| 5,362,075 | 11/1994 | Szendel | 280/11.27 |
| 5,374,072 | 12/1994 | Landers | 280/11.27 |

*Primary Examiner*—Richard M. Camby

[57] ABSTRACT

An improved fastening system for the axles of wheels of in-line roller skates is disclosed. This tri-axle system includes a multi-position spacer which is mounted in a spacer aperture in the skate chassis, which spacer has an axle aperture to receive the wheel axle. Both the spacer and the spacer aperture are generally triangular in shape. The axle aperture is offset from the geometric center of the spacer so as the spacer is rotated in the spacer aperture both the vertical and horizontal position of the axle may be altered with respect to the chassis. This allows a user to adjust both the wheelbase of the skate and the rocker easily and quickly.

16 Claims, 3 Drawing Sheets

TRI-AXLE SYSTEM FOR IN-LINE ROLLER SKATES

BACKGROUND OF THE INVENTION

The present invention relates to in-line roller skates and in particular to an adjustable axle system permitting a user to rocker the wheels and to adjust the wheelbase on an in-line roller skate.

In-line roller skates have a plurality of wheels mounted for rotation in a common plane on a chassis that is attached to a boot. The first such skates used non-adjustable axles to mount each wheel to the chassis. The axle was usually formed from a long threaded bolt and was fastened using a nut. The head of the bolt typically had sharp edges and the entire axle bolt often extended substantially beyond the nut. This presented a hazard to other skaters, skating rink surfaces and other objects.

Later these axle bolts were replaced with low profile round-headed bolts having smoother heads. These bolts were less problematic than the previous style and often used keys (eg. Allen keys) for the installation. On the "nut-side" the bolt was shortened so that the length was just sufficient to attach the nut.

Other improvements to the way axle bolts were received into the chassis were also developed. These changes permitted the axle bolts to be placed at different vertical positions thereby permitting a user to "rocker" the wheels similar to the rocker found on the blade of some ice skates.

Most of these prior art systems however, permitted only small adjustments to the rocker, which adjustments required an excessive amount of time and effort to accomplish. Often times only the most forward and most rearward wheels (skates usually have four wheels) were adjustable and then often into only one of two positions. This degree of adjustment was not sufficient to accommodate the preferences of a wide number of skaters. No skates are known which provided for adjustments to the wheelbase of the skate.

The limited amount of rockering was especially inadequate for certain specialized uses including the rapidly expanding number of competitive events using in-line roller skates. Furthermore, the degree of effort and time required to make these limited rockering adjustments proved especially onerous in a competitive environment.

It would therefore be desirable to have a fastening system to attach wheel axles (and thus wheels) to the chassis of an in-line roller skate which provided for a greater degree of adjustment of rocker and wheelbase to suit a user's preference, while making such adjustments an easier task.

SUMMARY OF INVENTION

According to the present invention there is provided an improved fastening system for attaching wheels to the chassis of an in-line roller skate. The system includes a three-position spacer that is insertable into an appropriately configured spacer aperture in the chassis. The spacer has an axle aperture therein to receive a wheel axle. These spacers can be rotated in the spacer apertures varying the vertical and horizontal position of the wheels in relation to the chassis.

The spacer is generally in the shape of an equilateral triangle. The axle aperture is offset from the geometric centre of the spacer, ie. being closer to one of the corners of the triangle. As the spacer is rotated in the spacer aperture, the axle position can be varied both horizontally and vertically in relation to the chassis and boot, thus allowing both adjustment to rocker and wheelbase. The triangular shape provides for three different positions of each spacer in its spacer aperture. Accordingly, in a skate with say, four wheels fastened in this manner, a large number of overall configurations are possible as the positions of each wheel are varied.

Thus, there is provided a fastening system for attaching a wheel to a chassis of an in-line roller skate. The side rails of the chassis are used for mounting at least one wheel therebetween and have at least one pair of substantially identically configured spacer apertures. These spacer apertures are generally triangular in shape and receive multi-position spacers also being generally triangular in shape. The wheel axles are configured to pass through the wheel and the multi-position spacers. The spacers have an appropriately configured axle aperture to receive the wheel axle, with this axle aperture being offset from the geometric centre of the spacer so that as the spacer is rotated within the spacer aperture the position of the axle aperture can be varied both vertically and horizontally with respect to the chassis.

DETAILED DESCRIPTION OF THE PREFERRED EMBODIMENT

Figure 1:
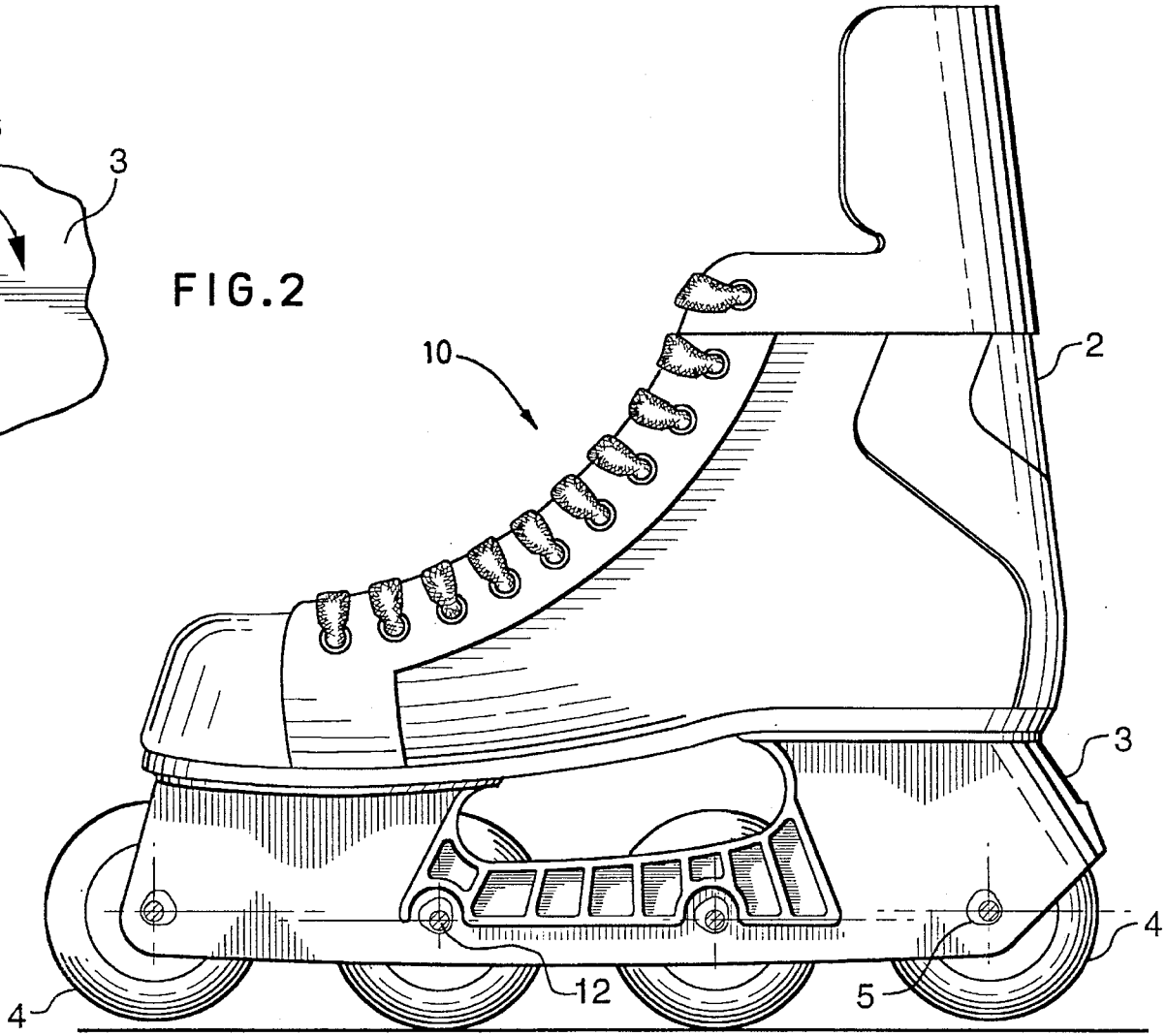
FIG. 1 is a side view of an in-line roller skate showing the wheels in one of a number different rockered positions.

An in-line roller skate 10 is shown in FIG. 1. The in-line skate 10 includes a boot 2 attached to a chassis 3 which supports a number of wheels 4.

Figure 6:
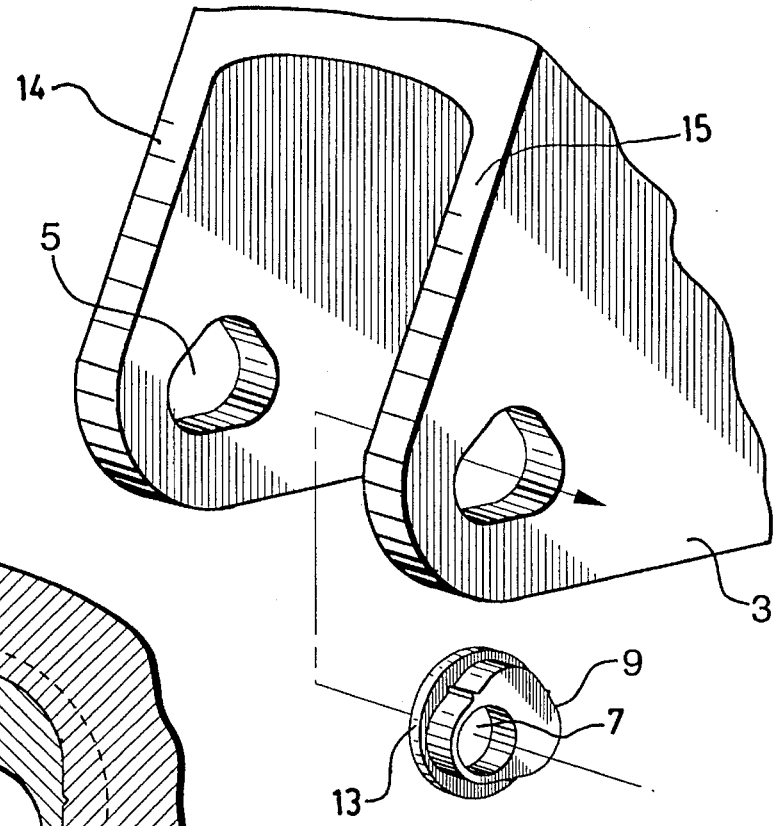
FIG. 6 is an exploded perspective view showing the way in which the spacer is inserted into the spacer aperture located in the side rails of the chassis.
Figure 8:
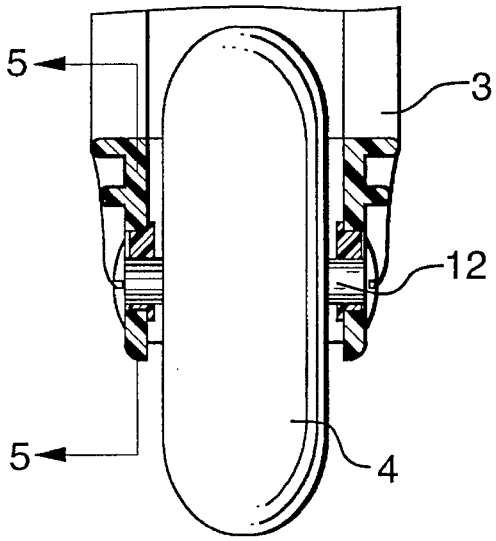
FIG. 8 is an end view of the entire fastening system of the present invention.

Referring to FIGS. 6 and 8, the wheels 4 are attached to a first chassis rail 14 and a second chassis rail 15 via a fastening system which is the subject of this application.

The fastening system is comprised of a number of substantially identical pairs of spacer apertures 5 located in first and second chassis rails 14 and 15. Each spacer aperture is configured to receive a multi-positioned spacer 9, and each spacer 9 in turn is configured to receive one end of a wheel axle 12.

The multi-position spacers 9 are configured to be received into the spacer apertures 5. The spacer apertures 5 and the body portion of the spacers 9 are both generally in the shape of equilateral triangles with rounded corners. Spacers 9 also have a slightly larger circular portion 13 which acts as a washer to prevent the spacer from passing all the way through the spacer aperture upon insertion.

Figure 5:
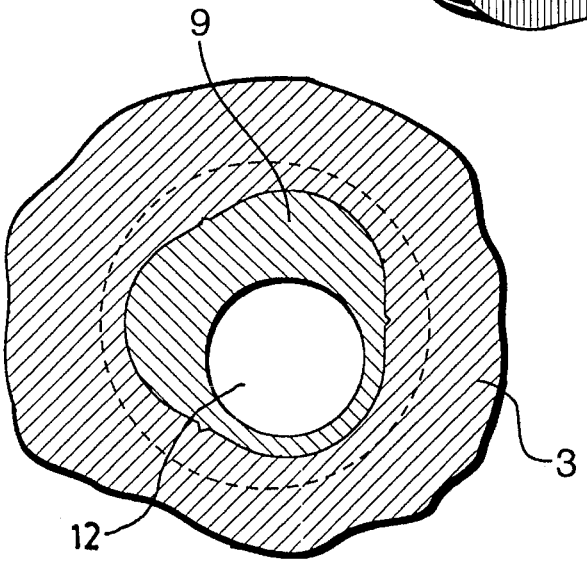
FIG. 5 is an enlarged cross-section showing the spacer received in the spacer aperture.
Figure 7:
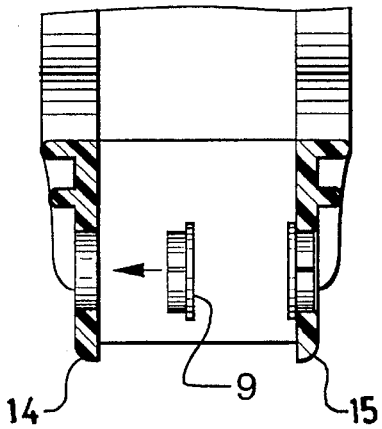
FIG. 7 is an end view of the spacer and the side rails showing insertion of the spacer into spacer aperture.

An axle aperture 7 in the form of a circular channel is provided in the spacer 9 which axle aperture receives a wheel axle 12. FIG. 5 shows a cross-sectional view of the chassis 3 with the multi-position spacer 9 and the wheel axle 12 in place. FIGS. 7 and 8 show how spacer 9 is inserted in chassis 3 and how axle 12 is then inserted together with wheel 4.

As can be seen from FIG. 6, axle aperture 7 is located generally towards one corner of triangular spacer 9. Thus depending on the orientation of spacer 9 as it is inserted into the spacer aperture 5, and on the fixed orientation of the spacer aperture 5 in the chassis 3, a number of different horizontal and vertical positions are possible for the wheel axles and thus the wheels. This is how the rockering and the wheelbase adjustments are achieved.

As an example, referring to FIG. 1, and specifically to the most forward and rearward wheels, three different configurations are possible for each wheel, namely:

1) the spacer can be located with the hole in the most forward position (the front wheel);
2) the spacer can be located with the hole in the most rearward position (the rear wheel); or
3) the spacer can be located with the hole in the spacer located at the top of the spacer aperture, being defined as the uppermost position. (not shown)

This provides three different possible axle locations for each of these wheels—thus the term "tri-axle."

Both the most forward and most rearward positions result in the axle being in the same vertical position but with the wheel being either slightly closer or slightly further from the centre wheels in the horizontal direction.

Having the spacer in the uppermost position results in the wheel being raised slightly in the vertical plane with respect to the other wheels 4. In this configuration, the horizontal position is intermediate between the most forward and most rearward spacer positions. These positions occur when the spacer aperture is orientated in the chassis having one side vertical when the skate is in an upright position.

Figure 3:
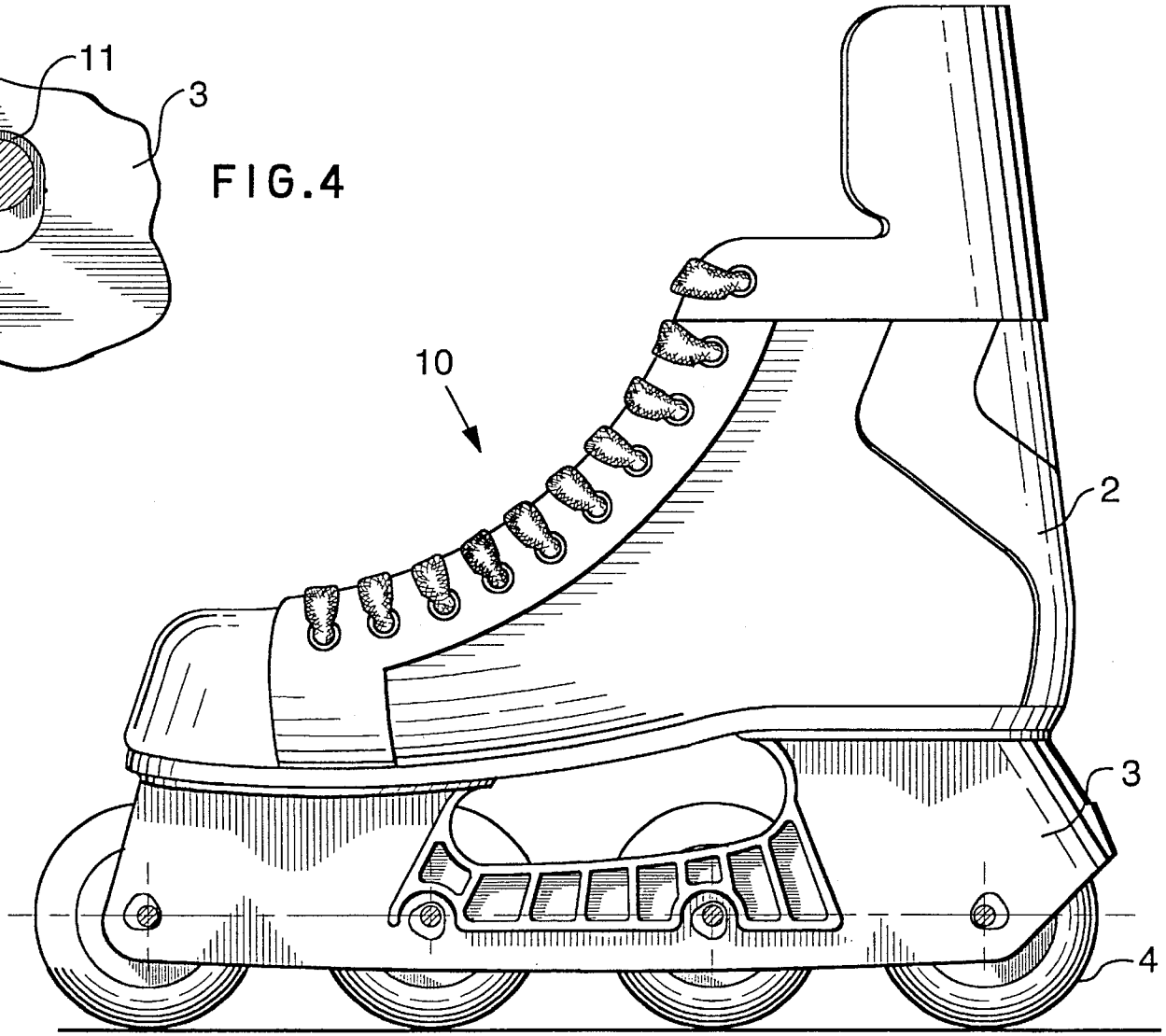
FIG. 3 is a side view of an in-line roller skate showing the wheels in one of a number of non-rockered positions.

Referring to FIGS. 1 and 3, it can be seen that the spacer apertures for the centremost wheels are orientated differently than those for the front and rear wheels, ie. with one side being vertical when the skate is in an upright position. The spacer apertures for the front and back wheels in contrast, are orientated with one side being horizontal when the skate is in an upright position. This configuration of the apertures in the chassis provides the widest range of rocker adjustment possible.

Thus a variety of permutations are possible when all four wheels are taken into consideration. Each wheel can be located in two vertical positions and three different horizontal positions permitting the utmost flexibility for the user in terms of wheelbase and rockering preferences.

The effect of this system can be seen in FIG. 1 where the most forward and the most rearward wheels of the skate 8 are in a slightly rockered position. In other words, when the skate is placed against a flat surface the two centremost wheels touch the surface while the most forward and most rearward wheels are slightly raised. This is due to the multi-position spacer 9 in the most forward and the most rearward spacer apertures 5 being rotated to raise the vertical height of the axle (and hence the wheel).

Figure 2:
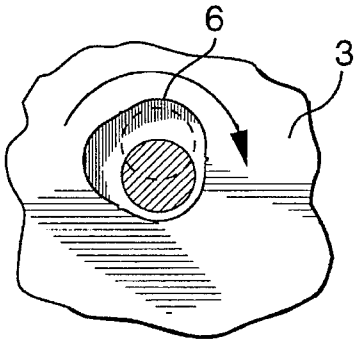
FIG. 2 is an enlarged view of the three-position spacer indicating how the position of the axle aperture changes as the spacer is rotated.

Referring to FIG. 2, a portion of the chassis 3 is shown with the multi-position spacer in a neutral position 6. Comparing FIG. 1 and FIG. 2, it can be seen that this is the position of the spacer with respect to the two centremost wheels shown on FIG. 1.

Figure 4:
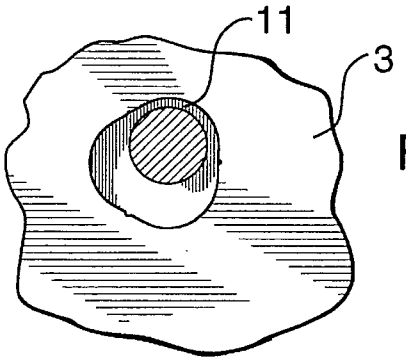
FIG. 4 is an enlarged view of the three position spacer as positioned at one of the centremost wheels as shown in the configuration of FIG. 3.

Referring now to FIGS. 3 and 4, an in-line roller skate 10 is shown with wheels in a non-rockered position. As can be seen, all four wheels are located in the same vertical position and as such all four wheels would touch simultaneously when the skate is placed on a smooth surface. FIG. 4 shows a close up of the orientation of the spacer aperture and the spacer for the centremost wheels in FIG. 3.

While the figures herein all show a skate with four wheels attached to the chassis, it is well known in the art that more or less than four wheels may be used and that a fastening system having any number of wheels is contemplated by the present invention.

While the preferred forms of the invention have been set forth and described in detail, it will be understood that this invention is not restricted to the particular details of construction and arrangements set forth and illustrated in the accompanying drawings, and it will be understood that changes may be made within the scope of what is hereinafter claimed.

What is claimed as the invention is:

1. A fastening system for attaching a wheel to a chassis of an in-line roller skate, said chassis having a first and second generally vertical and generally parallel spaced apart side rails for mounting wheels, said system comprising:

at least one pair of substantially identically configured spacer apertures, opposite each other, one in each side rail, each of said apertures being generally triangular in shape;

at least one pair of multi-position spacers with a generally triangular body portion configured to be received into said at least one pair of spacer apertures;

at least one wheel axle configured to pass through said at least one wheel and said at least one pair of multi-position spacers;

wherein said spacers have an appropriately sized axle aperture to receive said at least one wheel axle, said axle aperture being offset from the geometric centre of said spacer so that as the spacer is rotated within the spacer aperture the position of the axle aperture, and thus the axle and the wheel, can be varied horizontally and vertically with respect to the chassis.

2. The fastening system of claim 1, wherein the shape of said at least one pair of spacer apertures is substantially the shape of an equilateral triangle.

3. The fastening system of claim 1, wherein the shape of said at least one pair of spacers is substantially the shape of an equilateral triangle.

4. The fastening system of claim 1, wherein said spacers have an enlarged body section to prevent them from passing through the chassis upon insertion.

5. An in-line skate having the fastening system of claim 1.

6. An in-line skate having more than one wheel wherein all wheels are mounted using the fastening system of claim 1.

7. An in-line skate having four wheels wherein all wheels are mounted using the fastening system of claim 1.

8. An in-line skate as recited in claim 7, wherein the most forward and the most rearward pair of spacer apertures are orientated with one side being horizontal when the skate is in an upright position.

9. An in-line skate as recited in claim 7, wherein all spacer apertures are orientated with one side being horizontal when the skate is in an upright position.

10. An in-line skate as recited in claim 7, wherein the most forward and the most rearward pair of spacer apertures are orientated with one side being horizontal when the skate is in an upright position and the two centremost pairs of spacer apertures are orientated with one side being vertical when the skate is in an upright position.

11. An in-line skate having at least one wheel, a chassis having a first and second generally vertical and generally parallel spaced apart side rails for mounting said at least one wheel, and a fastening system for attaching said wheels to said rails, said fastening system comprising:

at least one pair of substantially identically configured spacer apertures, opposite each other, one in each side rail, each of said apertures being generally triangular in shape;

at least one pair of multi-position spacers with a generally triangular body portion configured to be received into said at least one pair of spacer apertures;

at least one wheel axle configured to pass through said at least one wheel and said at least one pair of multi-position spacers;

wherein said spacers have an appropriately sized axle aperture to receive said at least one wheel axle, said axle aperture being offset from the geometric centre of said spacer so that as the spacer is rotated within the spacer aperture the position of the axle aperture, and thus the axle and the wheel, can be varied horizontally and vertically with respect to the chassis.

12. An in-line skate as recited in claim 11, where said skate has more than one wheel, and where more than one of said wheels are mounted used said fastening system.

13. An in-line skate as recited in claim 12, where all of said skate's wheels are mounted using said fastening system.

14. An in-line skate as recited in claim 12, wherein the most forward and the most rearward pair of spacer apertures are orientated with one side being horizontal when the skate is in an upright position.

15. An in-line skate as recited in claim 12, wherein all spacer apertures are orientated with one side being horizontal when the skate is in an upright position.

16. An in-line skate as recited in claim 12, wherein the most forward and the most rearward pair of spacer apertures are orientated with one side being horizontal when the skate is in an upright position and the two centremost pairs of spacer apertures are orientated with one side being vertical when the skate is in an upright position.

* * * * *

UNITED STATES PATENT AND TRADEMARK OFFICE

CERTIFICATE OF CORRECTION

PATENT NO. : 5,505,470
DATED : April 9, 1996
INVENTOR(S) : T. Blaine Hoshizaki

It is certified that error appears in the above-indentified patent and that said Letters Patent is hereby corrected as shown below:

Col. 4, delete claims 5-10:
Claim 12, col. 6, line 4, change "11" to --5--
Claim 13, col. 6, line 7, change "12" to --6--
Claim 14, col. 6, line 9, change "12" to --6--
Claim 15, col. 6, line 13, change "12" to --6--
Claim 16, col. 6, line 16, change "12" to --6--

Signed and Sealed this

Seventeenth Day of September, 1996

*Attest:*

Bruce Lehman

BRUCE LEHMAN

*Attesting Officer*

*Commissioner of Patents and Trademarks*